US005777242A

United States Patent [19]

Zuidberg et al.

[11] Patent Number: 5,777,242

[45] Date of Patent: Jul. 7, 1998

[54] SOIL ANALYSIS AND SAMPLING SYSTEM

[75] Inventors: Herman Maria Zuidberg, Rijnsburg; Willem Henricus Schrier, Delft, both of Netherlands

[73] Assignee: Fugro Engineers B.V., SG Leidschendam, Netherlands

[21] Appl. No.: 875,551

[22] PCT Filed: Jan. 10, 1996

[86] PCT No.: PCT/NL96/00019

§ 371 Date: Jul. 11, 1997

§ 102(e) Date: Jul. 11, 1997

[87] PCT Pub. No.: WO96/21772

PCT Pub. Date: Jul. 18, 1996

[30] Foreign Application Priority Data

Jan. 11, 1995 [NL] Netherlands ..... 9500049

[51] Int. Cl.[6] ..... G01N 1/04

[52] U.S. Cl. ..... 73/864.45; 73/864.74

[58] Field of Search ..... 73/864.74, 784, 73/84, 152.11, 864.44, 864.45, 866.5; 175/40, 58

[56] References Cited

FOREIGN PATENT DOCUMENTS

| | | | |
|---|---|---|---|
| 896253 | 2/1945 | France | 175/58 |
| 72.23133 | 6/1972 | France . | |
| 2691257-A1 | 5/1992 | France . | |
| 39 06 227 C1 | 2/1989 | Germany . | |
| 89354 | 9/1955 | Netherlands . | |
| 86890 | 10/1957 | Netherlands . | |
| 7108761 | 6/1971 | Netherlands . | |
| 2 243 173 | 10/1991 | United Kingdom . | |

*Primary Examiner*—Robert Raevis
*Attorney, Agent, or Firm*—Darby & Darby

[57] ABSTRACT

A soil analysis and sampling system is provided with an outer tube (1) having near its outer end a part (3) with a decreased inside diameter and at its outer end a drilling head (1') having an opening in the centre; a series of extension tubes (2) which are connected to the top end of the outer tube (1); an upward seal (18) for the extension tubes (2); a pump system for introducing compressed fluid under the upward seal (18); and a tool provided with a hydraulic cylinder (8) cooperating with the outer tube (1), which cylinder (8) comprises a piston (9) moving in a linear motion when fluid pressure is exerted onto one side of the piston (9), and a rod (12), connected at one outer end with the piston (9) and at the other outer end with a sampling tube (13) or bottom hole analysis probe, whereby the downward movement of the piston pushes the tube (13) or probe below the drilling head (1') into the ground. The pump system is connected to the extension tubes (2) such that under the upward seal (18) fluid in the outer tube (1) and the extension tubes (2) can be compressed, and that the hydraulic cylinder (8) is provided at the top with a passage (24) allowing this fluid under pressure to enter above the piston (9) and wherein the cylinder (8) and piston (9) are provided with a control device (24') which causes the fluid under pressure to pass through at one side of the piston (9) at a substantially constant rate when the fluid in the extension tubes (2) is compressed.

12 Claims, 4 Drawing Sheets

SOIL ANALYSIS AND SAMPLING SYSTEM

BACKGROUND OF THE INVENTION

The invention relates to a bottom hole analysis and sampling system according to the preamble of claim 1.

Such systems are applied to carry out geotechnical ground analyses in order to determine the type and properties of grounds for the benefit of building and construction activities on land and off-shore. The invention relates in particular to systems in which bottom hole samples are taken and geotechnical experiments are carried out under the bottom end of drill holes. These samplings or analyses require that the velocity with which the probe or the sampling tube is pushed into the soil, is as constant as possible.

SUMMARY OF THE INVENTION

A system according to the prior art is provided with an outer tube comprising a series of extension tubes, provided at the bottom end with a drilling bit and wherein by rotation of the bit and rinsing with a suitable fluid a column of subterranean soil is removed by means of the tubes and the bit until the required depth is reached. A so-called cable tool is then lowered from the surface by means of the series of extension tubes, until it reaches a shoulder of the part of the outer tube having a decreased diameter. The tool is provided with a hydraulic cylinder in which a piston is connected to a rod which extends to the bottom end of the borehole via a hole in the middle of the drilling bit. The outer end of the rod is provided with a sampling tube or the analysis probe for the analysis of the properties of the subterranean soil. Via a tube fluid is fed under pressure from the surface to the hydraulic cylinder. When pressure is exerted on the top of the piston, the sampling tube or the analysis probe is driven into the ground under the bottom end of the borehole. The actual reactive force for the pressure on the rod is provided by the weight of the drill column which, if not sufficient, is supplemented by an extra weight which is coupled to the drill column at the surface. The equipment is provided with locking members, which after lowering of the tool, can be extended radially outward into a groove in the outer tube. When the rod is pushed into the ground, the reaction against the resistance to penetration is transmitted via the locking members to the outer tube. During lowering and raising, these hinged locking members are forcibly held in an inward position due to a tension in the hoisting cable, so that they can easily pass through the series of extension tubes. After lowering the tool onto the shoulder of the part with reduced diameter, the tension is removed from the hoisting cable and the locking members extend radially outward under the pressure of their own weight with the assistance of integrated springs so that, when the tool has been lowered correctly onto the shoulder, they fit into the groove of the outer tube. However, in practice this correct lowering is often hindered due to dirt on the shoulder, preventing the locking members from engaging the grooves so that the tool does not lock and when pressure is exerted on the piston by the compressed fluid, the tool will move upward instead of the rod being pushed downward into the ground. Even if the tool is positioned properly on the shoulder, the locking members may be hindered from engaging the groove in the outer tube due to dirt in the groove itself, resulting in the malfunctioning described above.

OBJECT OF THE INVENTION

It is the object of the invention to provide a bottom hole analysis and sampling system wherein this problem is effectively removed.

To this end the system according to the invention is characterized in that the pump system is connected to the extension tubes such that fluid under the upward seal in the outer tube and the extension tubes can be compressed, and that the hydraulic cylinder is provided at the top with a passage to allow this compressed fluid to enter above the piston and wherein the cylinder and piston are provided with a control device which allows the compressed fluid to pass through at one side of the piston with a substantially constant flow rate when the fluid in the extension tubes is compressed.

By these measures the reactive force from the rod is absorbed internally by the outer tube and the extension tubes, because the pressure on the piston is exerted by the fluid inside the tubes, pressing upward against the fixed seal. The substantially constant velocity of the piston and the rod is thereby guaranteed by means of the control device, which may simply be a passage provided with a metering valve. In any case, no locking members are needed, thus simplifying the construction and considerably enhancing the reliability of the equipment.

Although it is in principle possible, according to the invention, to design the outer tube itself as hydraulic cylinder, in one preferred embodiment of the invention the hydraulic cylinder is formed separate from the outer tube which houses the piston and constitutes part of the tool which is movable through the inside of the extension tube and which can be lowered in the outside tube, while the hydraulic cylinder and/or the outer tube are equipped with sealing means to provide a seal between the cylinder and the outer tube after the hydraulic cylinder has been lowered onto the part of the outside tube having the decreased diameter. In this way the piston is protected inside the hydraulic cylinder. Naturally, the total cross section of the outer tube above the hydraulic cylinder has then to be larger than the inside cross section of the hydraulic cylinder, because then the fluid pressure in the extension tubes keeps the hydraulic cylinder in the lowest position.

There are different possibilities for the construction of the tool's hydraulic cylinder and the positioning of the control device.

A further improvement according to the invention is the fact that in the embodiment in which the system is provided with means capable of converting the parameters measured by the analysis probe into electronic signals, the tool is provided with electric batteries for supplying the analysis probe and other measuring instruments with energy and with an electronic memory storing the data obtained during analysis from the probe and the measuring instruments and which memory can, after raising the tool by means of the series of extension tubes, be read out.

In this embodiment it is no longer necessary to have an electric cable running through the extension tubes to the tool. Such an electric cable limits the working depth of the system, impedes the functioning of the system and raises maintenance costs. According to the invention the maximum working depth is no longer limited by an electric cable, the maximum depth that can be reached is only determined by the clamp bell moving up and down.

Alternatively, electronic analysis signals may be transmitted to the surface by a drilling fluid pulsating telemetry system or with the aid of coded shock waves.

The invention will now be described in more detail with reference to the drawings illustrating a number of embodiments of the invention.

DETAILED DESCRIPTION OF THE INVENTION

In the different embodiments comparable parts are indicated with the same reference numbers.

Figure 1:
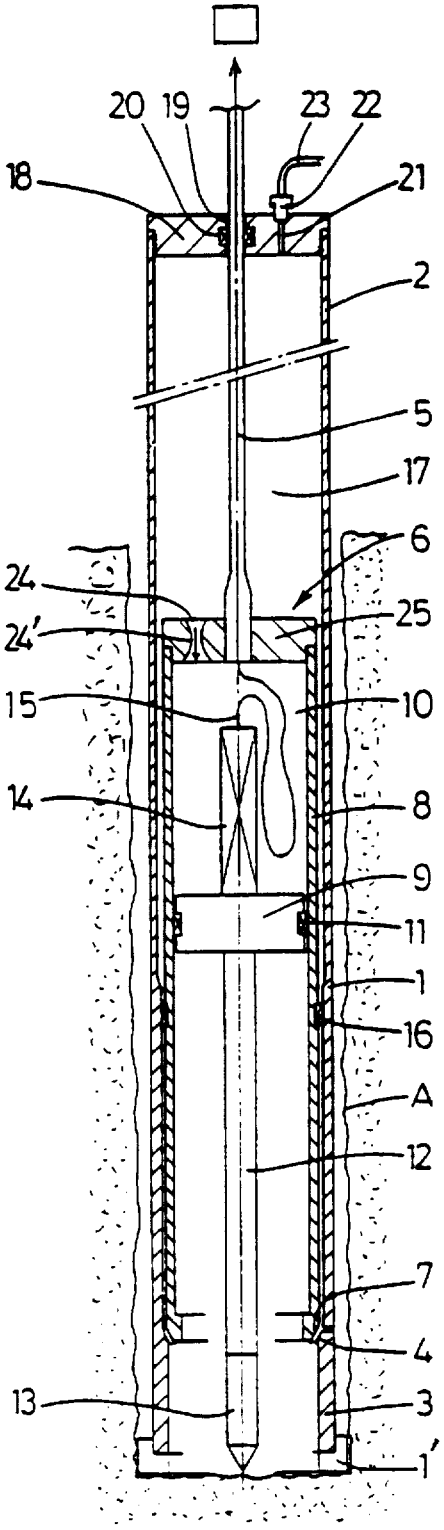
FIG. 1 is a vertical cross-section of a first embodiment, shown in the ground, of a soil analysis and sampling system according to the invention, which in this case comprises an analysis probe.

As already mentioned, FIG. 1 shows the first embodiment of the system according to the invention, which in this case is provided with means for analysing the bottom hole. The system comprises an outer tube 1 being circular in cross-section, provided at its bottom end with a schematically indicated drill head 1' having a central opening which at its top end is fastened to a (in the illustration only very short) series of extension tubes 2, the number of which is determined by the depth of a hole A made in the ground. The diameter of a part 3 of the outer tube 1 is reduced near its bottom end, forming a shoulder 4 at the point of transition between the two diameters. This shoulder 4 determines the lowest position of a tool 6 which is to be lowered in the extension tube 2 and the outer tube 1 by the hoisting means 5 to rest with its bottom edge 7 on the shoulder 4, thus determining the working position of the tool. The tool 6 comprises a hydraulic cylinder 8 having a piston 9 which is able to move downward inside the hydraulic cylinder 8 when the space 10 above the piston is put under pressure. The piston 9 is provided around its circumference with ring seals 11 sealing the inside wall of the hydraulic cylinder 8. At the underside of the piston 9 a rod 12 is mounted, extending axially in relation to the hydraulic cylinder 8, which rod may at its end be provided with various analysis and sampling means, being in this case an electric bottom hole analysis probe 13. The rod 12 is preferably hollow to allow an electric cable to be passed through to connect a probe 13 with an electric processor in a house 14 on top of the piston 9. In this embodiment the electronic processor is connected via a cable 15 through the hoisting means 5 with further (not shown) electronic processing means.

At a selected part of its circumference the hydraulic cylinder 8 of the tool 6 is provided with sealing means 16 which, when engaging a specially prepared part of the inside wall of the outer tube 1, forms a seal against very high pressures, so that the base of the space 17, which is formed by the outer tube 1 and the extension tubes 2, is sealed in the downward direction. In this case this space 17 is sealed in the upward direction by means of an upward seal in the form of an upper cover 18 for sealing the top end of the top extension tube 2. The upper cover 18 does have a passage 19 in its middle with a seal 20 to provide a sealed passage for the hoisting means 5. The upper cover 18 is also provided with a passage 21 having at its top end a connector 22 for connecting a tube 23 of a suitable pump system. This pump system can pump fluid, such as drilling fluid, into the space 17, in the extension tubes 2 and the outer tube 1, so that this space 17 becomes filled with compressed fluid. Because the fluid can be introduced at the top end of the extension tubes 2, no fluid pipes leading to the hydraulic cylinder 8 are necessary. This improves the reliability of the system and increases the maximum depth that can be obtained.

According to the invention this compressed fluid is used to drive the piston 9 in the hydraulic cylinder 8 with a more or less constant velocity. To this end the amount of fluid displaced per unit of time should, at least at one side of the piston 9, be substantially constant. In this embodiment care is taken that the space 10 above the piston 9 fills at a more or less constant rate causing the piston 9 to be pushed downward at a more or less constant rate so that the analysis probe is pushed into the ground at a more or less constant velocity. To this end the system according to the invention is provided with a control device comprising in this case a passage 24 having a metering valve 24', which passage is in this case provided in an upper seal part 25 of the hydraulic cylinder 8 of the tool 6. The bottom end of the hydraulic cylinder 8 is open, so that there is an open connection between the space below the piston 9 and the free space of the hole A.

According to the invention a good effect is achieved by very simple and reliable means. It is not necessary that the hydraulic cylinder 8 is locked in the outer tube 1, because the pressure in the space 17 above the hydraulic cylinder 8 keeps the entire tool 6 engaged with the shoulder 4. According to the invention, mechanical locking means, which may cause malfunctioning, are therefore obsolete.

Figure 1A:
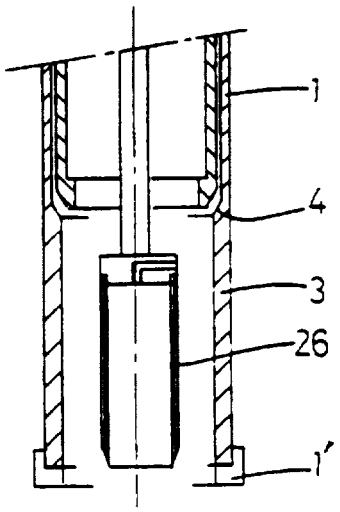
FIG. 1A shows schematically the lower part of FIG. 1 in the embodiment comprising a sampling tube.

FIG. 1A also shows that instead of being equipped with a probe 13, the rod 12 may also be equipped with a sampling tube 26, in which sampling tube, when it is pushed downward, a ground sample in the form of a column can be received and brought to the surface for further examination.

Figure 2:
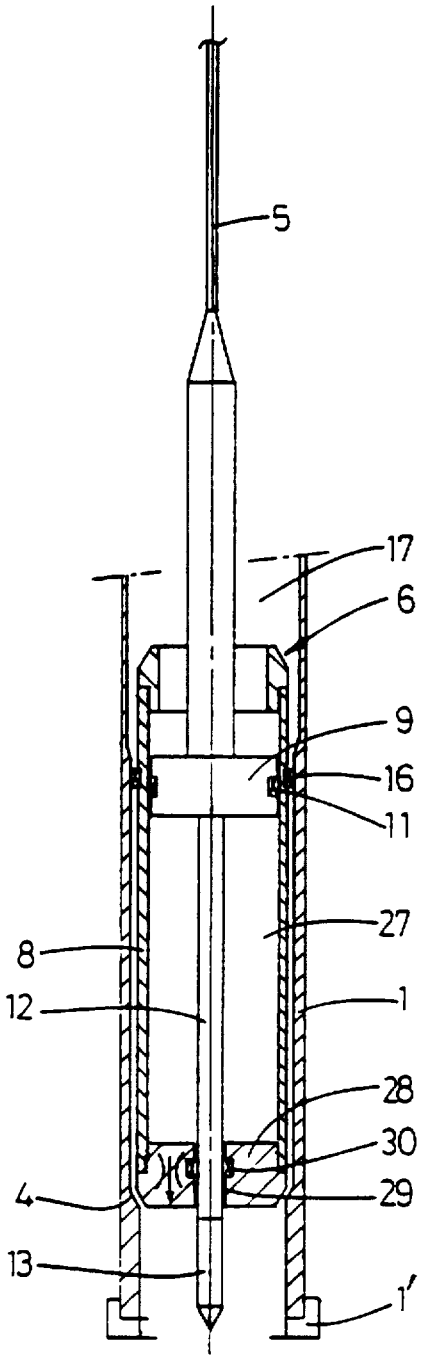
FIGS. 2, 3, 4, 4a and 5 are vertical cross-sections of alternative embodiments of the system according to the invention.

FIG. 2 shows an alternative embodiment in which the top end of the hydraulic cylinder 8 is open and the space 10 in the hydraulic cylinder 8 above the piston 9 stands in open connection with the space 17 in the outer tube 1 and the extension tubes 2. In this way the pressure of the fluid of the pump system in the space 17 is exerted directly onto the piston 9. The displacement rate of the piston 9, and thus of the sampling probe 13, is determined in this case by the gradual drainage of the space 27 inside the hydraulic cylinder 8 situated below the piston 9; because in this case, the hydraulic cylinder 8 is sealed at the bottom end by means of a bottom seal part 28. This bottom seal part 28 is provided with a passage 29 having a seal 30 to provide a sealed passage for the rod 12. In this embodiment the control device for draining the fluid from the space 27 at a more or less constant rate, is provided in the bottom seal part 28, as shown schematically by the passage 24 with the metering valve 24'.

Figure 3:
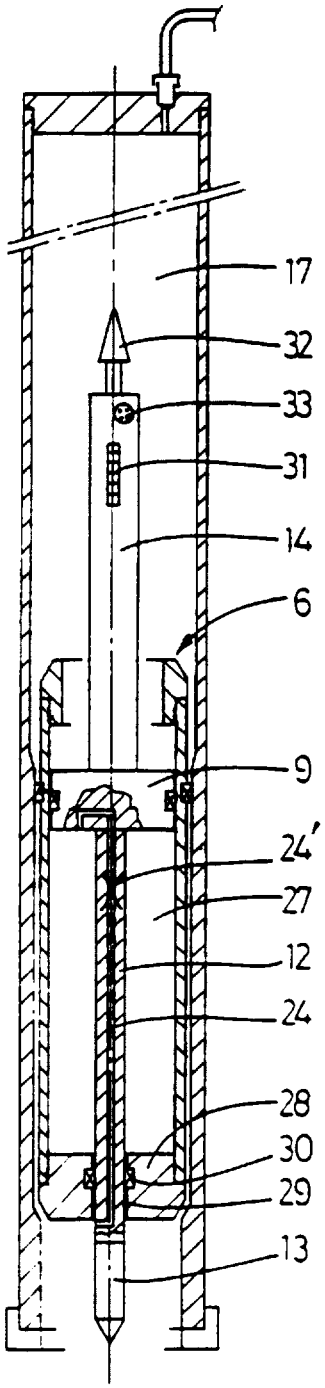

FIG. 3 shows a further alternative embodiment differing on two counts from the embodiment according to FIG. 2. First of all, the passage 24 of the control device is formed not in the bottom seal part 28 but in the piston 9 and the rod 12 such that in any position of the piston 9, the passage 24 can form a connection between the space 27 below the piston 9 and the free space under the bottom seal part 28. The working is the same as in FIG. 2.

Another difference can be found in a different house 14 having electronic components which have reference number 31. The electronic components 31 are provided with a battery and a memory for storing the electronic signals derived from the electronic components 31 from the parameters measured by the analysis probe. In addition the house 14 is provided at its top end with a catch pin 32 which can be caught by a clamp bell of a known structure in order to raise the tool 6, after sampling. In this embodiment the upper cover 18 does not need a passage for the hoisting means, because after lowering the tool 6 the extension tubes can be sealed at their top end by screwing on the upper cover 18. After analysis the upper cover 18 is removed and the clamp bell is lowered with the aid of the hoisting means and the tool 6 is raised. The electronic components 31 in the house 14 are subsequently connected via a connector 33 to a suitable computer system for the transmission of the data to another memory and for the display of relevant analysis data on a screen. A further extension of this embodiment allows the house 14 to accommodate further electronic components for processing the measuring data and for their visualization on a screen which can be read from the outside of the house 14, through a sealed sight-glass in the wall of the house 14. After raising the tool 6, the operator, by reading the data, is thus immediately able to judge whether the analysis was carried out correctly.

Figure 4:
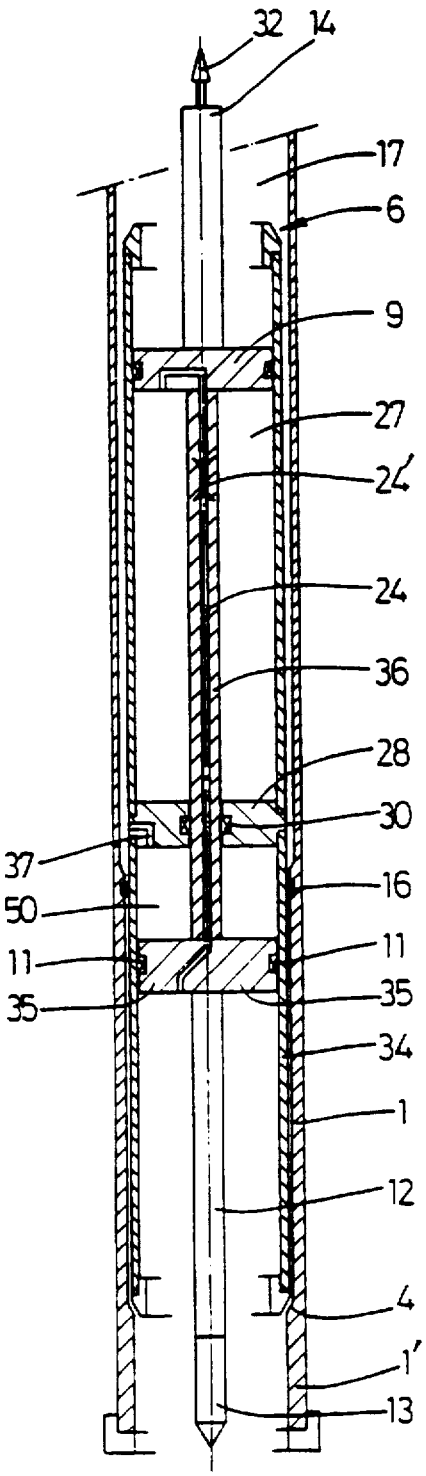

FIG. 4 shows a further embodiment which is in essence a duplication of the execution according to FIG. 3. That is to say, the hydraulic cylinder 8 of the tool 6 is supplemented in the downward direction with a second hydraulic cylinder below the bottom seal part 28 of the hydraulic cylinder 8. This second hydraulic cylinder 34 comprises a second piston 35 which is connected with piston 9 via a hollow connection rod 36. The bottom seal part 28 is provided with a passage 37 forming a connection between the space 17 inside the extension rods 2 and outer tube 1 above the seal 16 and a space 50 above the second piston 35 and the bottom seal part 28. The passage 24 of the control device extends in this case through the piston 9, the connection rod 36 and the second piston 35, ensuring, with the aid of the metering valve 24', a metered passage of fluid from the space 27 below the piston 9 to the free space under the second piston 35. By duplicating the embodiment, this system exerts a greater load on the analysis probe 13, or the same load is realized requiring less pressure from the pump system.

Figure 4A:
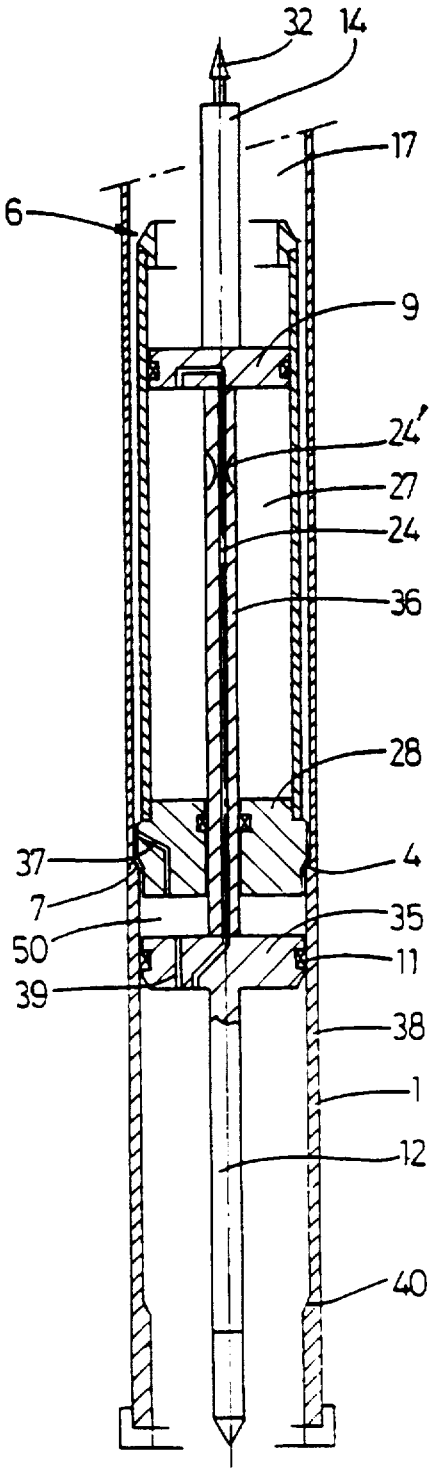

FIG. 4A shows a variant of FIG. 4, in which no second piston 35 is comprised in a second hydraulic cylinder 34 connected with the hydraulic cylinder 8, but in which a second hydraulic cylinder 38 is formed by the outer tube 1 itself. In this embodiment it is not necessary to provide the hydraulic cylinder 8 of the tool 6 with a seal 16, because the fact that fluid leaks from the space 17 along the hydraulic cylinder 8 and its seating 7 to below the bottom seal part 28 is no problem, on the contrary, it is the intention that the fluid flows under pressure from the space 17 via passage 37 into the space 50 between the bottom seal part 28 and the second piston 35. Thus, in this case it is the seal 11 of the second piston 35 that functions as the downward seal for the space 17 in the extension tubes 2 and the outer tube 1. The second piston 35 is provided with a small hole 39, allowing a small amount of drilling fluid to flow out of the space 33 in order to release the pressure in this space after analysis has taken place. In this embodiment a stop shoulder 40 near the lower end of the outer tube 1 provides a lowest stop of the second piston 35, thus limiting the stroke of the second piston 35.

Figure 5:
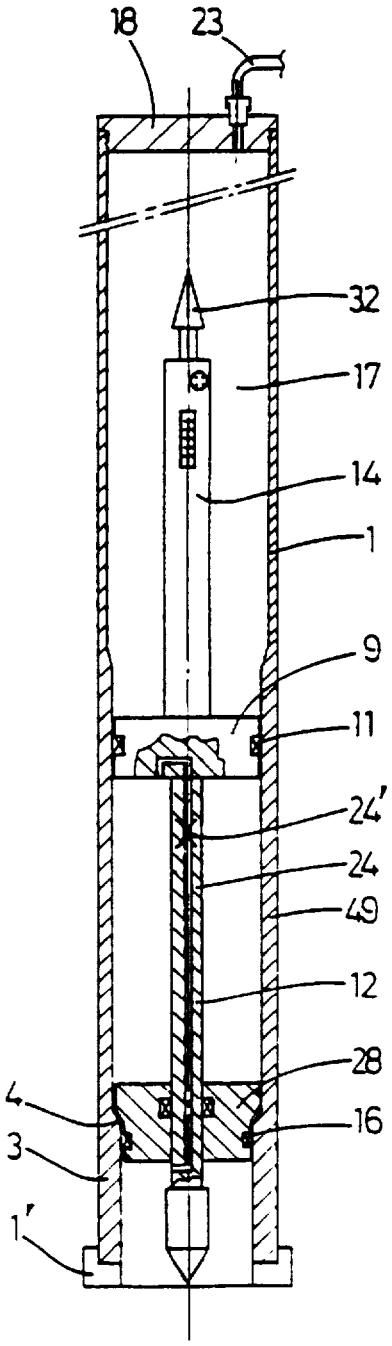

FIG. 5 shows a last embodiment where, in comparison with the embodiment according to FIG. 3, the hydraulic cylinder 8 of the tool 6 is omitted and, as with the second piston of the embodiment in FIG. 4A, a hydraulic cylinder 49 constitutes part of the outer tube 1, so that the piston 9 forms a seal directly against the inner wall of the outer tube 1. In this case the seal 16 of the tool 6 is provided on the outer circumference of the bottom seal part 28, which in this case seals the hydraulic cylinder 49 of the outer tube 1 while analysis takes place. This embodiment is particularly suitable for narrow tubes and sampling tubes and analysis probes that are required to carry out a very large stroke.

What is claimed is:

1. A soil analysis and sampling system comprising:

(a) an outer tube having near its outer end a part with a decreased inside diameter and at its outer end a drilling head having an opening in the centre;

(b) a series of extension tubes which are connected to the top end of the outer tube;

(c) an upward seal for the extension tubes;

(d) a pump system for introducing compressed fluid under the upward seal, wherein the pump system is connected to the extension tubes such that, under the upward seal, fluid in the outer tube and the extension tubes can be compressed; and (e) a tool comprising:

(1) a hydraulic cylinder cooperating with the outer tube, which cylinder includes a piston movable in a linear motion when fluid pressure is exerted onto one side of the piston, and (2) a rod, connected at one outer end with the piston and at the other outer end with a scientific device which is a sampling tube or a bottom hole analysis probe, whereby downward movement of the piston pushes the scientific device below the drilling head into the ground;

wherein the hydraulic cylinder is provided with a passage at the top to allow said fluid under pressure to enter above the piston; and the cylinder and piston are provided with a control device which causes the fluid under pressure to pass through at one side of the piston with a substantially constant rate when the fluid in the extension tubes is compressed.

2. A system according to claim 1, wherein the seal in the upward direction is formed by an upper cover for sealing the top end of the extension tubes, and the pump system can be connected to the extension tubes.

3. A system according to claim 1, wherein the hydraulic cylinder is formed separately from the outer tube, integrating the piston and forming part of the tool which can be moved inside the extension tubes and in the outer tube, and wherein at least one of the hydraulic cylinder and the outer tube comprise sealing means to provide a seal between the hydraulic cylinder and the outer tube after the hydraulic cylinder has been lowered onto the part of the outer tube having a reduced diameter.

4. A system according to claim 1, wherein the outer tube is a hydraulic cylinder.

5. A system according to claim 1, wherein the control device comprises a passage provided with a metering valve.

6. A system according to claim 1, wherein at its upper end the tool is provided with a catch pin for engagement by a clamp bell.

7. A system according to claim 1, wherein said scientific device is a bottom hole analysis probe and said system further comprises means for converting data parameters measured by the analysis probe into electronic signals.

8. A system according to claim 7, wherein the tool further comprises an electric battery for supplying the analysis probe with energy and an electric memory which stores the data obtained from the analysis probe.

9. A system according to claim 8, wherein the tool further comprises:

an electronic data processing system which summarizes data from at least the analysis probe, and a display which can be read externally showing the summarized data.

10. A system according to claim 8, further comprising a drilling fluid pulsating telemetry system for transmitting said data to the surface.

11. A system according to claim 8, further comprising means for transmitting said data signals via coded shock waves through the extension tubes.

12. A soil analysis and sampling system comprising:

(a) an outer tube having near its outer end a part with a decreased inside diameter and at its outer end a drilling head having an opening in the centre;

(b) a series of extension tubes which are connected to the top end of the outer tube;

(c) an upward seal for the extension tubes;

(d) a pump system for introducing compressed fluid under the upward seal and being connected to the extension tubes such that, under the upward seal, fluid in the outer tube and the extension tubes can be compressed; and (e) a tool comprising:

(1) a first hydraulic cylinder cooperating with the outer tube, (2) a first piston in said first cylinder movable in a linear motion when fluid pressure is exerted onto one side of the first piston, (3) a second hydraulic cylinder cooperating with the outer tube, (4) a second piston in said second cylinder movable in a linear motion when fluid pressure is exerted onto one side of the second piston, (5) a first rod connected between said first piston and said second piston, (6) a second rod connected at one end to the second piston, and (7) a scientific device which is a sampling tube or a bottom hole analysis probe, said scientific device connected to the other end of said second rod, whereby the downward movement of the second piston pushes the scientific device below the drilling head into the ground;

wherein, each said cylinder is provided with a passage at the top to allow said fluid under pressure to enter above the respective piston; and each said cylinder and piston is provided with a control device which causes the fluid under pressure to pass through at one side of each said piston with a substantially constant rate when the fluid in the extension tubes is compressed.

* * * * *